US006213339B1

(12) United States Patent
Lee

(10) Patent No.: US 6,213,339 B1
(45) Date of Patent: Apr. 10, 2001

(54) LIQUID CONTAINER WITH A STRAW THEREIN

(76) Inventor: Han-Pin Lee, 6F-2, No. 36, Tung Hsin East Street, Taichung (TW)

( * ) Notice: Subject to any disclaimer, the term of this patent is extended or adjusted under 35 U.S.C. 154(b) by 0 days.

(21) Appl. No.: 09/566,255

(22) Filed: May 5, 2000

(51) Int. Cl.[7] ..... A47G 19/00
(52) U.S. Cl. ..... 220/710; 215/388
(58) Field of Search ..... 220/705, 710, 220/715, 713; 222/402.21; 215/388

(56) References Cited

U.S. PATENT DOCUMENTS 5,305,810 * 4/1994 Meshberg ..... 220/710
5,388,712 * 2/1995 Brody ..... 220/705
5,406,991 * 4/1995 Rathenberg et al. ..... 220/705
6,135,311 * 10/2000 Danec et al. ..... 220/705

* cited by examiner

*Primary Examiner*—Joseph M. Moy
(74) *Attorney, Agent, or Firm*—Kenyon & Kenyon

(57) ABSTRACT

A liquid container comprises: a cap; a container body having an opening, an inner bottom, a first sealing means sealing a cross section of the container body, the opening being enclosed by the cap so as to form a chamber between the cap and the first sealing means; a straw having a circumferential wall, an open end and a closed end, the open end contacting with the first sealing means, the closed end being attached to the inner bottom of the container body, a first bore further formed on the circumferential wall of the straw above the closed end; and a hollow adapter disposed within the chamber, the adapter having an end for piercing the first sealing means to engage and connect the open end of the straw, whereby liquid within the container body can flow from the first bore, through the straw, and out of the adapter.

13 Claims, 4 Drawing Sheets

LIQUID CONTAINER WITH A STRAW THEREIN

FIELD OF THE INVENTION

The present invention relates to a liquid container with a straw provided therein so as to avoid the requirement of an external straw. The present invention also relates to a liquid container which facilitates the pouring of a liquid.

BACKGROUND OF THE INVENTION

Conventionally, water and soft drinks, such as juice and milk, are stored in a plastic container which has a container body with an opening, and a cap for enclosing the opening. In some cases, the opening of the container is further sealed by a layer of paperboard, plastics and aluminum, or other metallic foil. The above container has several disadvantages. First, if the container is to be suitable for personal use, an external straw will be needed to be inserted into the container body, in order to suck the liquid from the container. It is not easy for a user to get a straw outdoors. Second, if there is no straw, a user has to directly drink the liquid by putting his/her mouth against the edge of the opening, which is inconvenient, particularly if the user is driving. Third, for a larger container, the opening of the container body will be large. Sudden pouring of the liquid into a glass cup makes the liquid splash out of the glass cup easily and may even turn the glass cup over. Fourth, since the layer of paperboard, plastics and aluminum or other metallic foil has to be torn off before drinking, the liquid therein is easily contaminated. If the container is accidentally turned over, the liquid therein will be spilled.

Further, as shown in FIG. 1, in using a container which stores medicament preparation, such as a hemodialysis concentrate, a user has to tear off a layer of foil covering on the opening of the container and insert a tube therein which has an end further connecting to an adapter of a hemodialysis machine. In this way, the hemodialysis concentrate is easily contaminated by particulates or bacteria in the air. Further, while withdrawing the tube out of the container, some concentrate may drop on the user's skin or clothes, which may cause damages thereto.

Therefore, it is necessary to have a liquid container which is convenient for a user to suck the liquid therefrom without the requirement of an external straw or to smoothly pour the liquid into a glass cup. It is also necessary to provide with a liquid container, wherein the liquid will not be contaminated or accidentally contact with a user's skin or clothes.

SUMMARY OF THE INVENTION

To overcome the above drawbacks, an objective of the present invention is to provide a liquid container with a straw therein, such that no external straw is required.

Another objective of the present invention is to provide a liquid container which has a straw therein for guiding the flow of liquid out of the container. By inserting an adapter into the straw, the liquid within the container can flow smoothly out of the container by means of the straw.

The other objective of the present invention is to provide a liquid container wherein the liquid therein will not be contaminated or contact with a user's skin or clothes.

To achieve the above objectives, the liquid container in accordance with the present invention, comprises: a cap; a container body having an opening, an inner bottom, a first sealing means sealing a cross section of the container body, the opening being enclosed by the cap so as to form a chamber between the cap and the first sealing means; a straw having a circumferential wall, an open end and a closed end, the open end contacting with the first sealing means, the closed end being attached to the inner bottom of the container body, a first bore further formed on the circumferential wall of the straw above the closed end; and a hollow adapter disposed within the chamber, the adapter having an end for piercing the first sealing means to engage and connect the open end of the straw, whereby liquid within the container body can flow from the first bore, through the straw, and out of the adapter.

The structure and objectives of-the present invention will be more readily understood by those skilled in the art from the following description of the preferred embodiments taken in conjunction with the accompanying drawings.

DETAILED DESCRIPTION OF THE PREFERRED EMBODIMENTS

Figure 1:
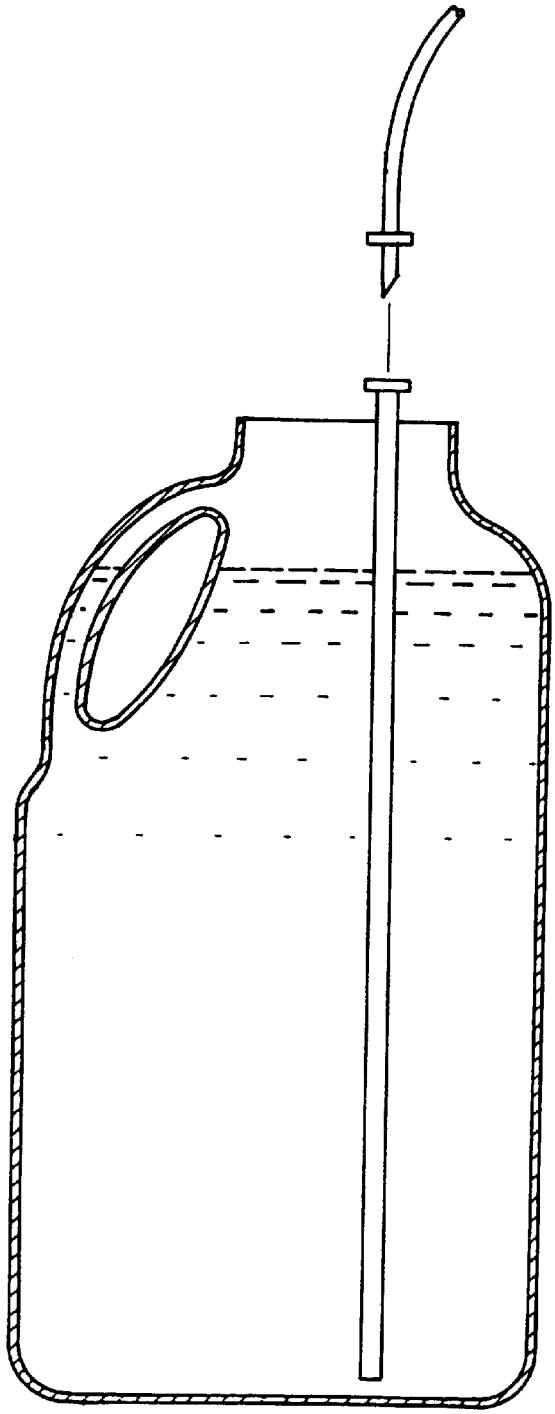
FIG.1 (PRIOR ART)
FIG. 1 is a schematic view of the conventional container for hemodialysis.
Figure 2:
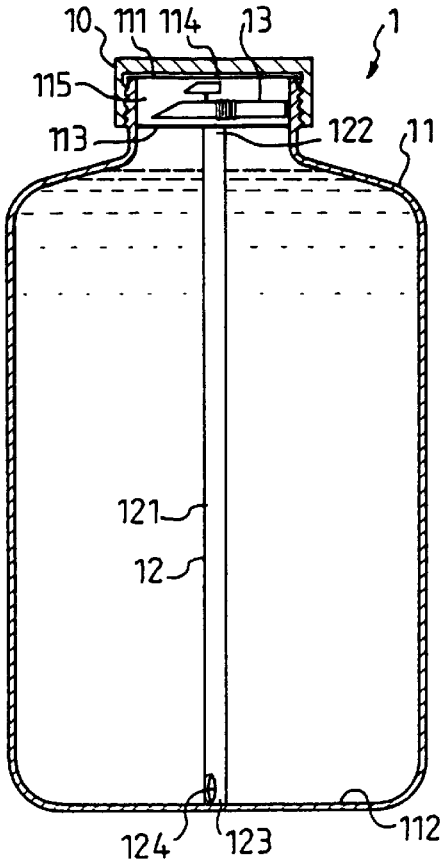
FIG. 2 is a schematic view of the liquid container in accordance with the first preferred embodiment of the present invention.

FIG. 2 shows a liquid container 1, or a bottle 1, in accordance with the first preferred embodiment of the present invention. The liquid container 1 comprises a cap 10, a container body 11, a straw 12 and an adapter 13.

The container body 11 further has an opening 111, an inner bottom 112, a first sealing means 113, and a second sealing means 114. The first sealing means 113 seals a cross section of the container body 11 at a distance from the opening 111. The second sealing means 114 covers the opening 111 which is then enclosed by the cap 10.

Both the first sealing means 113 and the second sealing means 114 are preferably a layer of aluminum foil and can also be a layer of paperboard, plastics or other metallic foil. A chamber 115 is formed between the first sealing means 113 and the second sealing means 114.

The straw 12 has a circumferential wall 121, an open end 122 and a closed end 123. The open end 122 contacts with the first sealing means 113 of the container body 11 with a mark (not shown) at the point of contact thereon. The closed end 123 is securely connected to the inner bottom 112 of the container body 11, in which the connection is made by adhesion or may be achieved by integral formation. A first bore 124 is further formed on the circumferential wall 121 of the straw 12, near and above the closed end 123.

The adapter 13 is disposed within the chamber 115 formed between the first sealing means 113 and the second sealing means 114. The adapter 13 comprises a hollow main tube 131 and a hollow vent tube 132, which are interconnected in parallel by a horizontal solid link 133 which divides the main tube 131 into an upper portion 134 and a lower portion 135. Since the vent tube 132 is used for balancing the pressure inside and outside the container 1, to prevent the liquid flowing out from the vent tube 132, the diameter and length of the vent tube 132 do not have to be large and are respectively smaller and shorter than those of the main tube 131. The main tube 131 is used for engaging with the open end 122 of the straw 12 and thus the lower portion 135 has a sharp end for piercing the first sealing means 113. The upper portion 134 of the main tube 131, above the link 133, is bellowed such that the upper portion 134 can be bent towards a user's mouth. The vent tube 132 is used for air flowing into the container body 11 such that the pressure inside and outside the container body 11 can be balanced and the liquid within the container body 11 will flow out of the container body 11 easier. Therefore, the vent tube 132 also has a sharp end for piercing the first sealing means 113.

Figure 3:
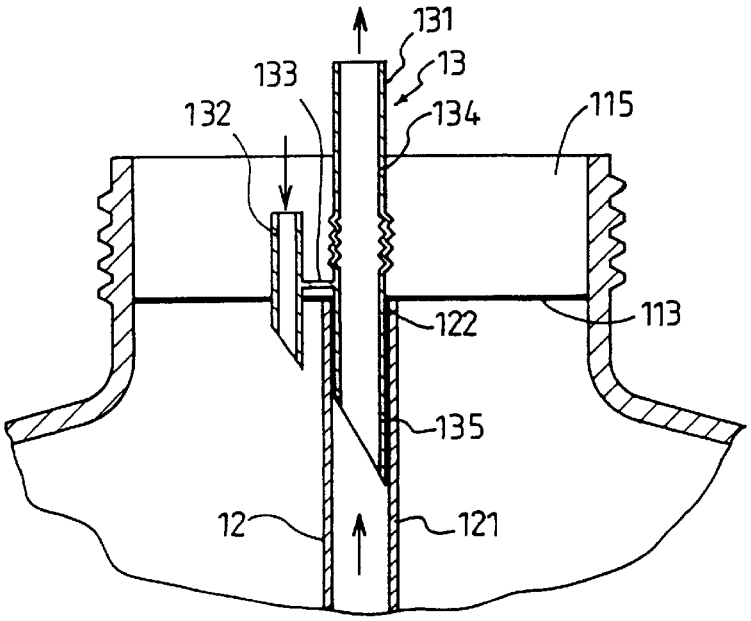
FIG. 3 is an enlarged view of the liquid container in accordance with the first preferred embodiment of the present invention, wherein the adapter engages with the straw.

As shown in FIGS. 2 and 3, in using the liquid container 1, a user first takes off the cap 10 and breaks the second sealing means 114 with their fingers. Then, the main tube 131 of the adapter 13 pierces the first sealing means 113 at the marked position and engages with the open end 122 of the straw 12. At the same time, the vent tube 132 of the adapter 13 also pierces the first sealing means 113. Accordingly, by sucking the main tube 131, the liquid within the container body 11 can flow from the first bore 124, through the straw 12, and out of the main tube 131.

According to the current embodiment, no external straw is required and the liquid within the container 1 is not contaminated. Further, if the liquid container 1 with the liquid remaining therein is to be stored within a refrigerator, the user does not have to separate the adapter 13 from the straw 12. He only needs to bend the upper portion 134 such that the adapter 13 can be stored within the chamber 115 for the cap 10 to close the opening 111.

Figure 4:
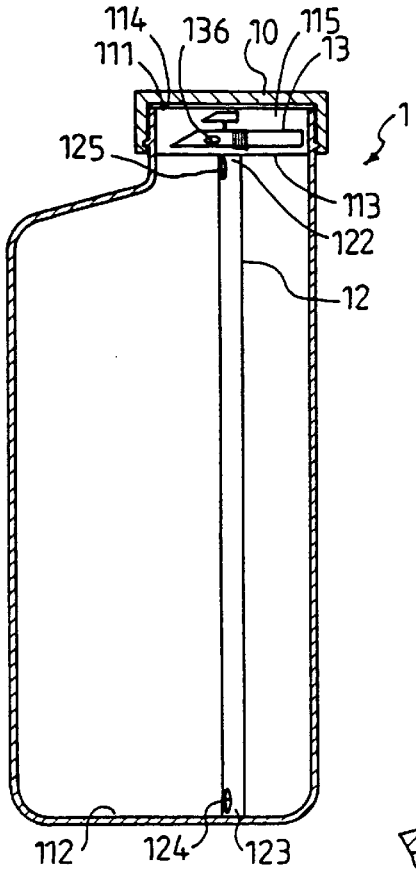
FIG. 4 is a schematic view of the liquid container in accordance with the second preferred embodiment of the present invention.
Figure 5:
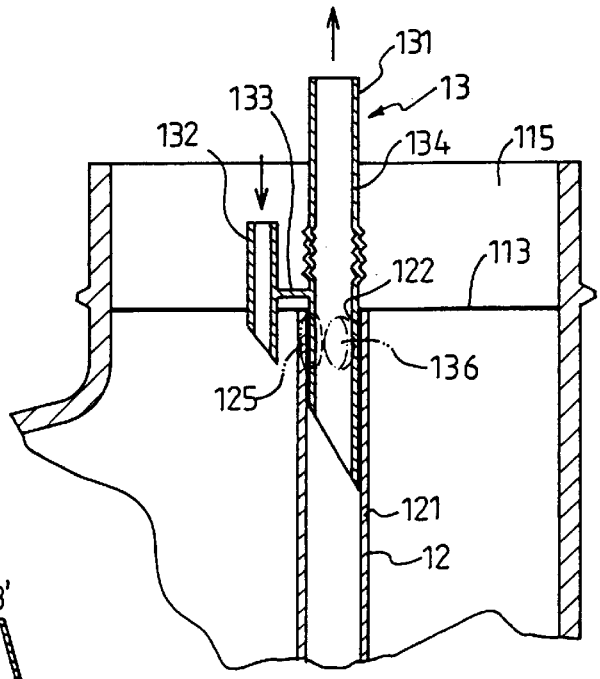
FIG. 5 is an enlarged view of the liquid container in accordance with the second preferred embodiment of the present invention, wherein the adapter engages with the straw.

The liquid container 1 shown in FIGS. 2 and 3 can be modified by further forming a second bore 125 on the circumferential wall 121 of the straw 12, near the open end 122, and forming a bore 136 on the circumferential wall of the lower portion 135 of the main tube 131, as shown in FIGS. 4 and 5.

In the current embodiment, if the bore 136 of the adapter 13 does not align with the second bore 125 of the straw 12, the function of the liquid container 1 is the same as that in the first embodiment. Namely, the liquid can only be sucked out of the main tube 131. Otherwise, by aligning the bore 136 of the adapter 13 with the second bore 125 of the straw 12, instead of sucking the main tube 131, the liquid within the container body 11 can automatically flow out by turning the container body 11 upside down.

Since the flow rate of the liquid flowing out of the container 1 through the main tube 131 is adjustable, even if the container 1 is turned upside down, the liquid flow does not splash out of a glass cup. In addition, the liquid within the container 1 is not easily contaminated.

Figure 6:
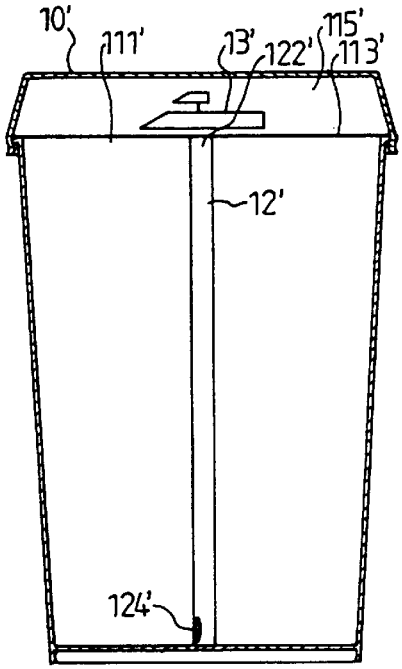
FIG. 6 is a schematic view of the liquid container in accordance with the third preferred embodiment of the present invention.

FIG. 6 shows a liquid container 1', or a jar 1' in accordance with the third preferred embodiment of the present invention. To simplify the description, the elements in the third preferred embodiment corresponding to those in the first preferred embodiment are denoted by the same reference numerals with an apostrophe In the current embodiment, the structure of the liquid container 1' is substantially the same as that of the container 1 in the first preferred embodiment, except that only one sealing means 113' is used to cover the opening 111', which is then enclosed by a cap 10'. A chamber 115' is formed between the cap 10' and the sealing means 113' for an adapter 13' to be stored therein. Further, the open end 122' of the straw 12' contacts with the sealing means 113' of the container body 11' with a mark (not shown) at the point of contact thereon.

In using the liquid container 1', a user first takes off the cap 10'. Then the main tube 131' of the adapter 13' pierces the sealing means 113' at the marked position and engages with the open end 122' of the straw 12'. At the same time, the vent tube 132' of the adapter 13' also pierces the sealing means 113'. Accordingly, the liquid within the container body 11' can flow from the first bore 124', through the straw 12', and out of the adapter 13'.

Figure 7:
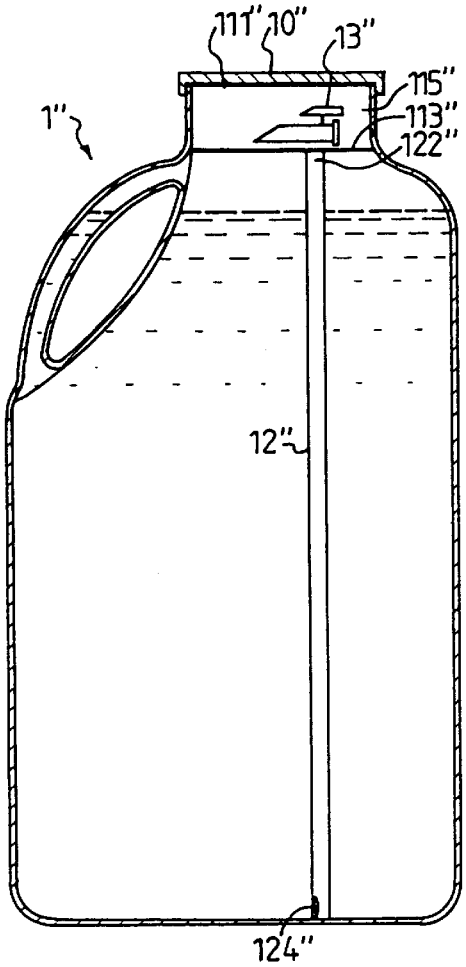
FIG. 7 is a schematic view of the liquid container in accordance with the fourth preferred embodiment of the present invention.

FIG. 7 shows a liquid container 1" in accordance with the fourth preferred embodiment of the present invention. To simplify the description, the elements in the fourth preferred embodiment corresponding to those in the first preferred embodiment are denoted by the same reference numerals with a quotation mark (").

In the current embodiment, the liquid container 1" is primarily used for storing medicament preparation, such as hemodialysis concentrate. The structure of the liquid container 1" is substantially the same as that of the container 1 in the first preferred embodiment, except that only one sealing means 113" is used to seal a cross section of the container body 11" and is below the opening 111". The cap 10" encloses the opening 111" and a chamber 115" is formed between the cap 10" and the sealing means 113" for an adapter 13" to be stored therein. Further, the open end 122" of the straw 12" contacts with the sealing means 113" of the container body 11" with a mark (not shown) at the point of contact thereon.

In using the liquid container 1", a user first takes off the cap 10". Then, a sharp end of the main tube 131" of the adapter 13" pierces the sealing means 113" at the marked position and engages with the open end 122" of the straw 12". The other end of the main tube 131" connects with an adapter of a hemodialysis machine. At the same time, the vent tube 132" of the adapter 13" also pierces the sealing means 113". Accordingly, the liquid within the container body 11" can flow from the first bore 124", through the straw 12", and out of the main tube 131".

In the current embodiment, the hemodialysis concentrate will not be contaminated by particulates or bacteria in the air. In addition, the concentrate will not drop on the user's skin or clothes to cause damages thereto.

Figure 8:
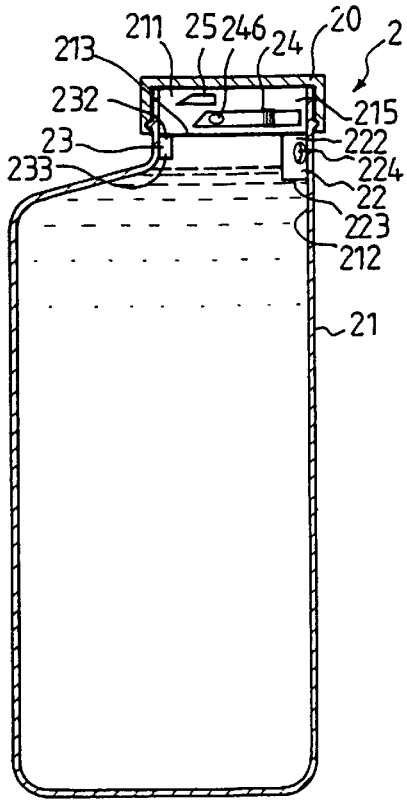
FIG. 8 is a schematic view of the liquid container in accordance with the fifth preferred embodiment of the present invention.
Figure 9:
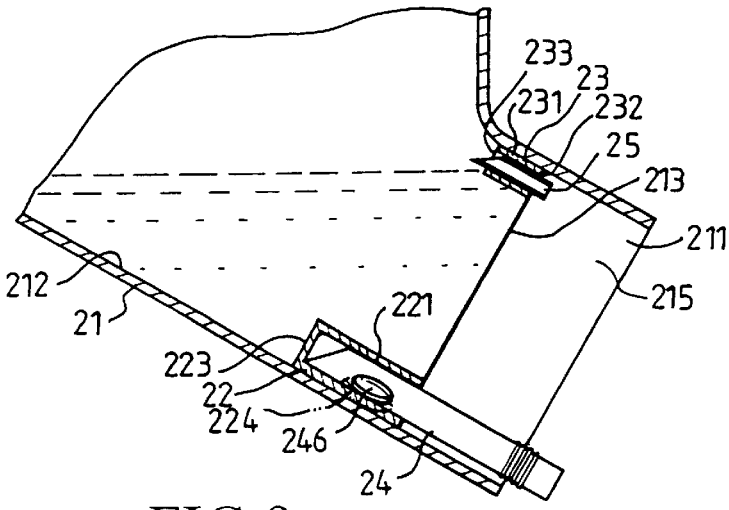
FIG. 9 is a enlarged view of the liquid container in accordance with the fifth preferred embodiment of the present invention, wherein the adapter engages with the straw and the liquid flows out of the container.

FIGS. 8 and 9 show a liquid container 2 in accordance with the fifth preferred embodiment of the present invention. The liquid container 2 comprises a cap 20, a container body 21, a first short straw 22, a second short straw 23, a main adapter 24 and a vent adapter 25. The container body 21 has an opening 211, an inner wall 212 and a sealing means 213.

The sealing means 213 seals a cross section of the container body 21 at a distance from the opening 211. The sealing means 213 is preferably a layer of aluminum foil and can also be a layer of paperboard, plastics or other metallic foil. The cap 20 encloses the opening 211 and a chamber 215 is formed between the cap 20 and the sealing means 213.

The first straw 22 has a circumferential wall 221, an open end 222 and a closed end 223. The circumferential wall 221 is attached to the inner wall 212 of the container body 21 and the open end 222 contacts with the sealing means 213 of the container body 21 with a first mark (not shown) at the point of contact thereon. A bore 224 is further formed on the circumferential wall 221 of the first straw 22, preferably adjacent to the inner wall 212 of the container body 21.

The second straw 23 has a circumferential wall 231, a first open end 232 and a second open end 233. The circumferential wall 231 is attached to the inner wall 212 of the container body 21, substantially opposite to the first straw 22. The first open end 232 of the second straw 23 contacts with the sealing means 213 of the container body 21 with a second mark (not shown) at the point of contact thereon. The diameter and length of the second straw 23 do not have to be large, and are respectively smaller and shorter than those of the first straw 22.

The main adapter 24 and the vent adapter 25 are respectively a hollow tube disposed within the chamber 215, with each having a sharp end for piercing the sealing means 213 and respectively engaging with the open end 222 of the first straw 22 and the first open end 232 of the second straw 23. Similarly, the diameter and length of the vent adapter 25 do not have to be large, and are respectively smaller and shorter than those of the main adapter 24. A bore 246 is formed on a circumferential wall of the main adapter 24. In addition, a portion of the main adapter 24, above the bore 246, can be bellowed.

In using the liquid container 2, a user first takes off the cap 20. Then the main adapter 24 pierces the sealing means 213 at the first marked position and engages with the open end 222 of the first straw 22. Further, the vent adapter 25 also pierces the sealing means 213 at the second marked position and engages with the first open end 232 of the second straw 23. By laying down the container body 21 toward the side with the first straw 22 attached thereto, air can flow into the container body 21 through the second straw 23, and the liquid within the container body 21 can flow from the bore 224 of the first straw 22 out of the main adapter 24.

In the current embodiment, while laying down the container body 21 on its side with the first short straw 22 attached thereto, if the bore 246 of the main adapter 24 does not align with the bore 224 of the first straw 22, the liquid within the container body 21 cannot flow out. By aligning the bore 246 of the main adapter 24 with the bore 224 of the first straw 22, the liquid within the container body 21 can flow from the bore 224. That is to say, the flow rate of the liquid can be adjusted by the alignment of the bore 224 on the first straw 22 with the bore 246 on the main adapter 24.

Since the flow rate of the liquid flowing out of the container 2 through the main adapter 24 is adjustable, even if the container 2 is turned upside down, the liquid flow does not splash out of a glass cup. In addition, the liquid within the container 2 is not easily contaminated.

If the liquid container 2 with the liquid remaining therein is to be stored within a refrigerator, the user does not have to separate the main adapter 24 from the first straw 22. He only needs to first misalign the bore 246 of the main adapter 24 with the bore 224 of the first straw 22, and further bend the bellowed portion such that the main adapter 24 can be stored within the chamber 215 for the cap 20 to close the opening 211.

The structures disclosed in the above embodiments are merely directly to the preferred embodiments in accordance with the present invention. However, the present invention may also have other modifications without departing from the spirit of the present invention. For example, in the first embodiment, the inner bottom 112 of the container body 11 can have a convex central portion with the remaining portion of the inner bottom 112 flat and the closed end 123 of the straw 12 is attached to the flat portion of the inner bottom 112. In addition, the vent tube is not an essential element and the adapter can only comprise the main tube. Moreover, in the fifth embodiment, the second straw 23 can be L-shaped such that by laying the container body 21 on its side with the first straw 22 attached thereto, air can flow into the container body 21 through the second straw 23 and the liquid will not flow out therefrom.

The structure of the present invention is not limited to the above embodiments. Although the invention has been described with reference to the preferred embodiments, it will be obvious to those skilled in the art that various changes and modifications may be made without departing from the scope of the invention as recited in the claims.

What is claimed is:

1. A liquid container, comprising:

a cap;

a container body having an opening, an inner bottom, a first sealing means sealing a cross section of the container body, the opening being enclosed by the cap so as to form a chamber between the cap and the first sealing means;

a straw having a circumferential wall, an open end and a closed end, the open end contacting with the first sealing means, the closed end being attached to the inner bottom of the container body, a first bore further formed on the circumferential wall of the straw above the closed end; and a hollow adapter disposed within the chamber, the adapter having an end for piercing the first sealing means to engage and connect the open end of the straw, whereby liquid within the container body can flow from the first bore, through the straw, and out of the adapter.

2. The container body according to claim 1, wherein the first sealing means covers the opening of the container body.

3. The container body according to claim 1, further comprising a second sealing means which covers the opening of the container body.

4. The container body according to claim 3, wherein each of the first sealing means and the second sealing means is made of layer-shaped material.

5. The liquid container according to claim 1, wherein the adapter is a hollow main tube and further comprises a hollow vent tube which has an end and is interconnected in parallel with the main tube by means of a horizontal link, whereby when the end of the main tube pierces the first sealing means, the end of the vent tube also pierces the first sealing means such that air can flow from the vent tube into the container body.

6. The liquid container according to claim 5, wherein the straw further comprises a second bore on the circumferential wall thereof, near the open end and opposite to the vent tube, and the main tube further has a circumferential wall with a bore formed thereon and below the link, whereby when the main tube engages with the open end of the straw and the second bore of the straw aligns with the bore of the main tube, by laying the container body down, the liquid within the container will flow out of the container easily.

7. The liquid container according to claim 1, wherein the inner bottom of the container body has a convex central portion with the remaining portion of the inner bottom flat and the closed end of the straw is attached to the flat portion of the inner bottom.

8. A liquid container, comprising:

a cap;

a container body having an opening, an inner wall, a first sealing means sealing a cross section of the container body, the opening being enclosed by the cap so as to form a chamber between the cap and the first sealing means;

a first short straw having a circumferential wall, an open end and a closed end, the circumferential wall being attached to the inner wall of the container body and having a bore formed thereon, the open end contacting with the first sealing means;

a main adapter disposed within the chamber, the main adapter having a circumferential wall, and an end for piercing the first sealing means to engage and connect the open end of the first straw, a bore being formed on the circumferential wall of the main adapter, whereby when the main adapter engages with the open end of the first short straw, the flow rate of the liquid can be adjusted by the alignment of the bore on the first short straw with that on the main adapter, and by laying the container body down, liquid within the container body can flow from the bore of the first short straw, and out of the main adapter.

9. The liquid container according to claim 8, wherein the first sealing means covers the opening of the container body.

10. The liquid container according to claim 8, further comprising a second sealing means which covers the opening of the container body.

11. The liquid container according to claim 10, wherein each of the first sealing means and the second sealing means is made of layer-shaped material.

12. The liquid container according to claim 8, further comprises:

a second short straw having a circumferential wall, a first open end and a second open end, the circumferential wall being attached to the inner wall of the container body, substantially opposite to the first short straw, the first open end of the second straw contacting with the first sealing means; and a vent adapter disposed within the chamber, the vent adapter having an end for piercing the first sealing means to engage and connect the first open end of the second short straw, whereby air can flow into the container body through the vent adapter and the second short straw.

13. The liquid container according to claim 9, wherein the second short straw is L-shaped.

* * * * *